US011751750B2

(12) United States Patent
Kim et al.

(10) Patent No.: US 11,751,750 B2
(45) Date of Patent: Sep. 12, 2023

(54) RACK ASSEMBLY AND DISHWASHER HAVING SAME

(71) Applicant: SAMSUNG ELECTRONICS CO., LTD., Suwon-si (KR)

(72) Inventors: Dae Joung Kim, Suwon-si (KR); Jae Jun Kim, Suwon-si (KR); Gi Sung Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 169 days.

(21) Appl. No.: 17/293,552

(22) PCT Filed: Oct. 23, 2019

(86) PCT No.: PCT/KR2019/013995
§ 371 (c)(1),
(2) Date: May 13, 2021

(87) PCT Pub. No.: WO2020/101202
PCT Pub. Date: May 22, 2020

(65) Prior Publication Data

US 2022/0000332 A1 Jan. 6, 2022

(30) Foreign Application Priority Data

Nov. 13, 2018 (KR) ..... 10-2018-0139131

(51) Int. Cl.
*A47L 15/50* (2006.01)

(52) U.S. Cl.
CPC ..... *A47L 15/507* (2013.01)

(58) Field of Classification Search
CPC ..... A47L 15/50; A47L 15/502; A47L 15/503; A47L 15/504; A47L 15/506; A47L 15/507; A47L 15/28; A47L 15/34
(Continued)

(56) References Cited

U.S. PATENT DOCUMENTS 7,621,605 B2 * 11/2009 Bond ..... A47B 46/005 312/325
7,862,664 B2 * 1/2011 Choi ..... A47L 15/502 134/201

(Continued)

FOREIGN PATENT DOCUMENTS

DE 102015120882 A1 * 6/2017
EP 0966913 10/2003

(Continued)

OTHER PUBLICATIONS

International Search Report dated Feb. 28, 2020 in International Patent Application No. PCT/KR2019/013995.

(Continued)

*Primary Examiner* — Patrick D Hawn

(74) *Attorney, Agent, or Firm* — STAAS & HALSEY LLP

(57) ABSTRACT

Disclosed are a rack assembly capable of enhancing usability by improving a rack assembly structure, and a dishwasher having the rack assembly. The dishwasher includes: a washing tub; and a rack assembly provided inside the washing tub, wherein the rack assembly includes: a frame; a tray on which dishes are accommodated and which is movably supported on the frame; and a link unit connecting the frame to the tray and moving the tray to one of a first location and a second location that is lower than the first location, the link unit being rotatably coupled with the frame and the tray.

13 Claims, 13 Drawing Sheets

(58) Field of Classification Search
USPC ..... 211/41.3–41.9
See application file for complete search history.

(56) References Cited

U.S. PATENT DOCUMENTS

| | | | | |
|---|---|---|---|---|
| 8,163,103 | B2 * | 4/2012 | Shin | A47L 15/502 134/84 |
| 8,191,560 | B2 * | 6/2012 | Mallory | A47L 15/503 134/145 |
| 8,746,467 | B2 * | 6/2014 | Jeong | A47J 47/16 211/126.2 |
| D725,325 | S * | 3/2015 | Lee | D32/3 |
| 9,241,608 | B2 * | 1/2016 | Shin | A47L 15/504 |
| 9,265,404 | B2 | 2/2016 | Fey et al. | |
| 9,420,882 | B2 * | 8/2016 | Garcia | A47B 46/005 |
| 9,474,436 | B2 | 10/2016 | Seu | |
| 9,516,990 | B2 * | 12/2016 | Graute | A47L 15/504 |
| 9,532,702 | B2 | 1/2017 | Wegener et al. | |
| 9,545,185 | B2 * | 1/2017 | Lee | A47L 15/4409 |
| 9,833,122 | B2 * | 12/2017 | Shin | A47L 15/501 |
| 10,052,011 | B2 * | 8/2018 | Shin | A47L 15/504 |
| 10,080,478 | B2 * | 9/2018 | Jeong | A47L 15/502 |
| 10,602,910 | B2 * | 3/2020 | Gutkowski | A47L 15/506 |
| 10,743,742 | B2 * | 8/2020 | Buesing | A47L 15/506 |
| 10,779,705 | B2 * | 9/2020 | Ko | A47L 15/506 |
| 11,406,244 | B2 * | 8/2022 | Ko | A47L 15/502 |
| 2010/0155280 | A1 | 6/2010 | Graute et al. | |
| 2014/0137907 | A1 * | 5/2014 | Shin | A47L 15/504 134/135 |
| 2015/0245761 | A1 | 9/2015 | Zhou et al. | |
| 2022/0133125 | A1 * | 5/2022 | Chojnacki | A47L 15/505 134/164 |
| 2022/0386847 | A1 * | 12/2022 | Park | A47L 15/505 |

FOREIGN PATENT DOCUMENTS

| | | | | |
|---|---|---|---|---|
| EP | 2201887 | | 7/2012 | |
| EP | 2272416 | | 3/2013 | |
| EP | 2134230 | | 10/2013 | |
| EP | 2134233 | | 5/2014 | |
| EP | 2364635 | | 5/2014 | |
| EP | 2820998 | | 1/2015 | |
| EP | 1702552 | | 10/2015 | |
| EP | 2277433 | | 10/2015 | |
| EP | 2754377 | | 11/2015 | |
| EP | 2277432 | | 3/2016 | |
| EP | 2433549 | | 5/2016 | |
| EP | 3175763 | A1 * | 6/2017 | |
| EP | 3175765 | A1 * | 6/2017 | A47L 15/502 |
| EP | 3175766 | A1 * | 6/2017 | |
| EP | 3409182 | B1 * | 1/2020 | A47L 15/502 |
| EP | 3599967 | B1 * | 3/2021 | A47L 15/504 |
| ES | 2897739 | T3 * | 3/2022 | A47L 15/502 |
| KR | 10-1318361 | | 10/2013 | |
| KR | 10-2014-0064120 | | 5/2014 | |
| KR | 10-2014-0064121 | | 5/2014 | |
| KR | 10-2017-0021641 | | 2/2017 | |
| WO | WO-2014067243 | A1 * | 5/2014 | A47L 15/502 |
| WO | 2014/102737 | | 7/2014 | |
| WO | WO-2015185636 | A1 * | 12/2015 | A47B 46/005 |
| WO | WO-2017174565 | A1 * | 10/2017 | |
| WO | WO-2022045615 | A1 * | 3/2022 | |

OTHER PUBLICATIONS

Office Action dated May 15, 2023 issued in Korean Patent Application No. 10-2018-0139131.

* cited by examiner

RACK ASSEMBLY AND DISHWASHER HAVING SAME

CROSS-REFERENCE TO RELATED APPLICATIONS

This application is a U.S. National Stage Application which claims the benefit under 35 U.S.C. § 371 of International Patent Application No. PCT/KR2019/013995, filed on Oct. 23, 2019, which claims the priority benefit of Korean Patent Application No. 10-2018-0139131, filed on Nov. 13, 2018 in the Korean Patent and Trademark Office, the contents of which are incorporated herein by reference.

TECHNICAL FIELD

The present disclosure relates to a dishwasher, and more particularly, to a dishwasher with an improved rack assembly structure.

BACKGROUND ART

In general, a dishwasher is an appliance for automatically washing off food residues, etc. on dishes with a detergent and washing water.

A dishwasher includes a main body, a tub positioned inside the main body, an accommodating container positioned inside the tub to accommodate dishes, and a spray unit for spraying washing water toward the accommodating container.

The accommodating container includes a basket in which dishes of relatively large volumes are accommodated, and a rack assembly in which dishes of relatively small volumes, such as cutlery, are accommodated.

The accommodating container of the dishwasher needs to accommodate dishes having various sizes.

DISCLOSURE

Technical Problem

An aspect of the present disclosure is directed to providing a rack assembly capable of enhancing usability by improving a rack assembly structure, and a dishwasher having the rack assembly.

Another aspect of the present disclosure is directed to providing a rack assembly capable of enhancing space efficiency by changing an inside accommodating space of a dishwasher, and a dishwasher having the rack assembly.

Still another aspect of the present disclosure is directed to providing a dishwasher capable of improving loading by adjusting a height of an accommodating space of a rack assembly of the dishwasher.

Technical Solution

One aspect of the present disclosure provides a dishwasher including: a washing tub; and a rack assembly provided inside the washing tub, wherein the rack assembly includes: a frame; a tray on which dishes are accommodated and which is movably supported on the frame; and a link unit connecting the frame to the tray and moving the tray to one of a first location and a second location that is lower than the first location, the link unit being rotatably coupled with the frame and the tray.

Also, the link unit may include a moving bracket movably supported on the frame, and a link member connecting the moving bracket to the tray and rotatably coupled with the moving bracket and the tray.

Also, the link member may include a first connecting portion rotatably connected to the moving bracket, and a second connecting portion rotatably connected to the tray, wherein the first connecting portion and the second connecting portion may be positioned at both end portions of the link member.

Also, the link unit may include a lever device restricting a movement of the link member such that the tray is positioned at the first location.

Also, the lever device may include a lever rotatably installed in the moving bracket, and a slot formed in the link member and being coupled with or decoupled from the lever.

Also, the lever may include a fixing portion that is coupled with or decoupled from the slot.

Also, the fixing portion may include a guide portion inclined to guide the fixing portion to be coupled with or decoupled from the slot.

Also, the lever may be rotatably installed in the moving bracket.

Also, the lever may include an elastic member positioned between the lever and the moving bracket to elastically support the lever and the moving bracket.

Also, the tray may interwork with a rotation of the lever, and rotate by an own weight when the tray moves from the first location to the second location.

Also, the moving bracket may include a frame supporting groove formed for the moving bracket to be supported on the frame, and a roller supporting the frame.

Also, the link member may be provided as a plurality of pieces.

Also, the tray may include a first tray and a second tray, and the first tray and the second tray may be provided in both left and right sides of the frame to be symmetrical to each other.

Also, the first tray positioned at the second location may be movable toward the second tray positioned at the first location, and the first tray and the second tray may be stacked at upper and lower locations.

Also, the tray may include at least one handle.

Another aspect of the present disclosure provides a rack assembly for washing dishes in a washing tub, the rack assembly including: a frame; a tray movably supported on the frame; and a link unit connecting the frame to the tray and moving the tray to one of a first location and a second location that is lower than the first location, the link unit being rotatably coupled with the frame and the tray.

Also, the rack assembly may further include a moving bracket movably supported on the frame.

Also, the link member may include a first connecting portion rotatably connected to the moving bracket, and a second connecting portion rotatably connected to the tray, wherein the first connecting portion and the second connecting portion may be positioned at both end portions of the link member.

Also, the link unit may further include a lever device restricting a movement of the link member such that the tray is positioned at the first location.

Also, the lever device may include a lever rotatably installed in the moving bracket, and a slot formed in the link member and being coupled with or decoupled from the lever.

Advantageous Effects

According to an embodiment of the disclosure, by improving a rack assembly structure to change an inside accommodating space of a dishwasher, space efficiency may be enhanced.

Also, because a height of the accommodating space of the rack assembly of the dishwasher is adjustable, space efficiency and usability may be enhanced.

MODES OF THE INVENTION

Figure 1:
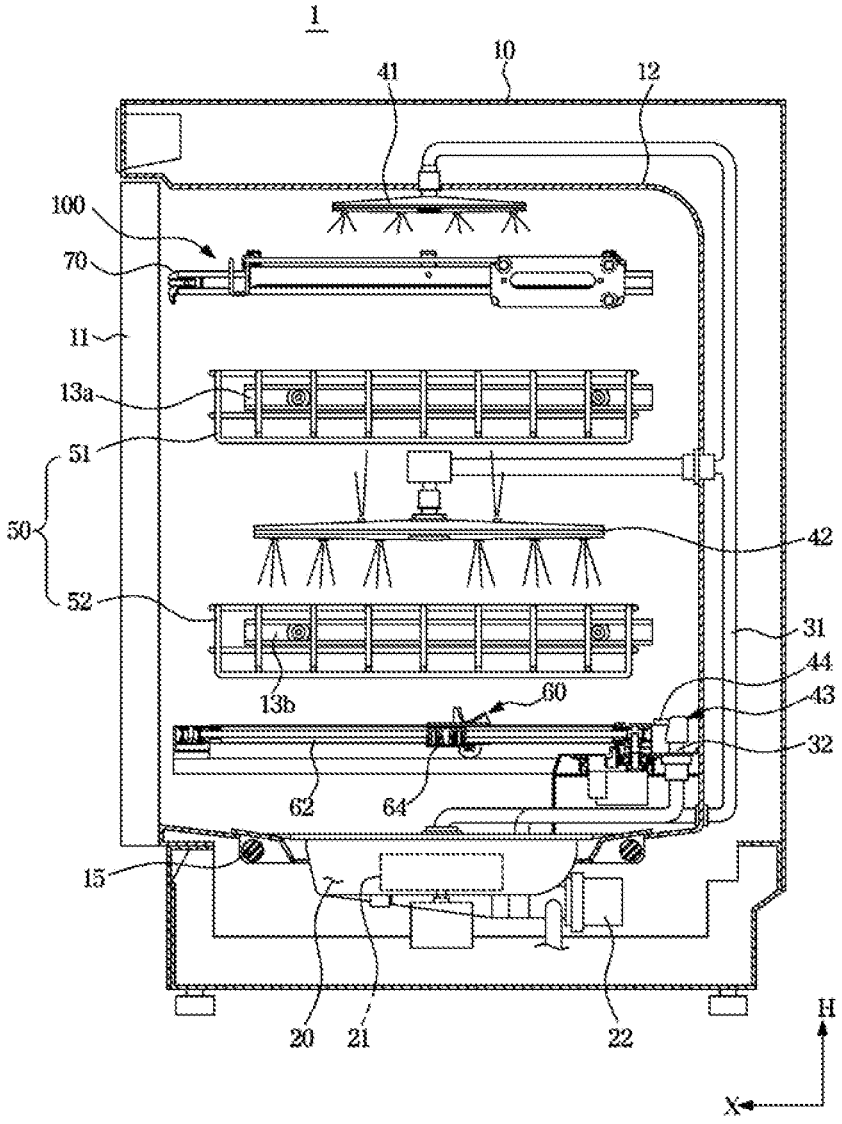
FIG. 1 is a cross-sectional view of a dishwasher according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms "first," "second," etc. may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

Hereinafter, embodiments of the disclosure will be described in detail with reference to the accompanying drawings.

Figure 2:
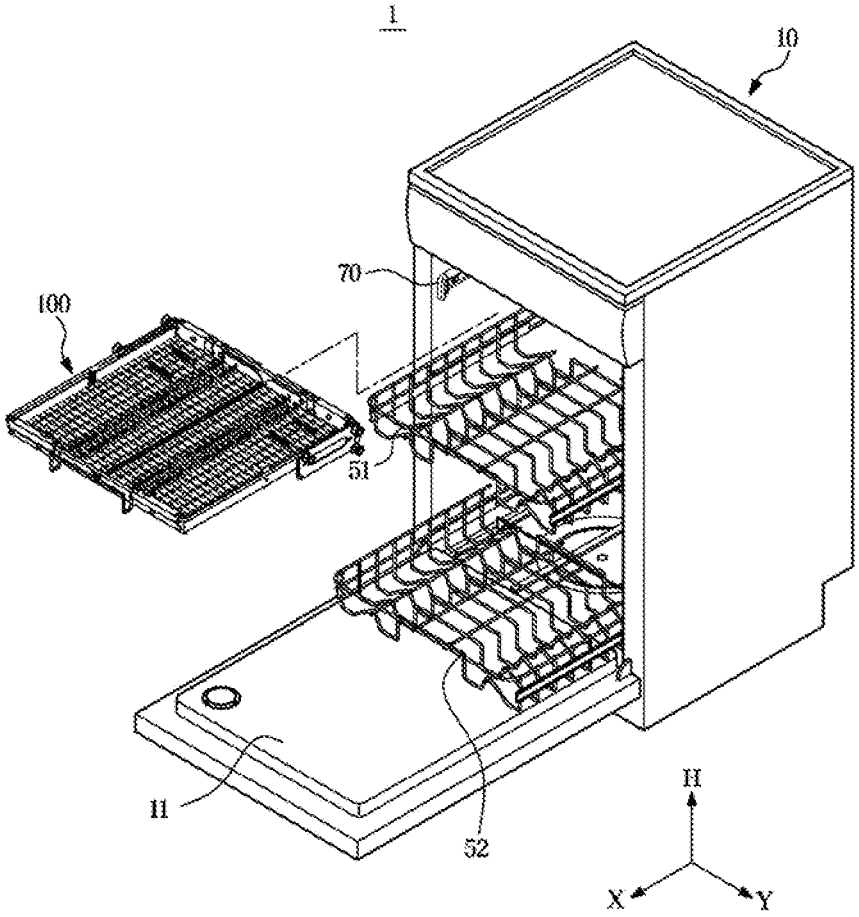
FIG. 2 is a perspective view of a dishwasher according to an embodiment of the disclosure when a door of the dishwasher opens.
Figure 3:
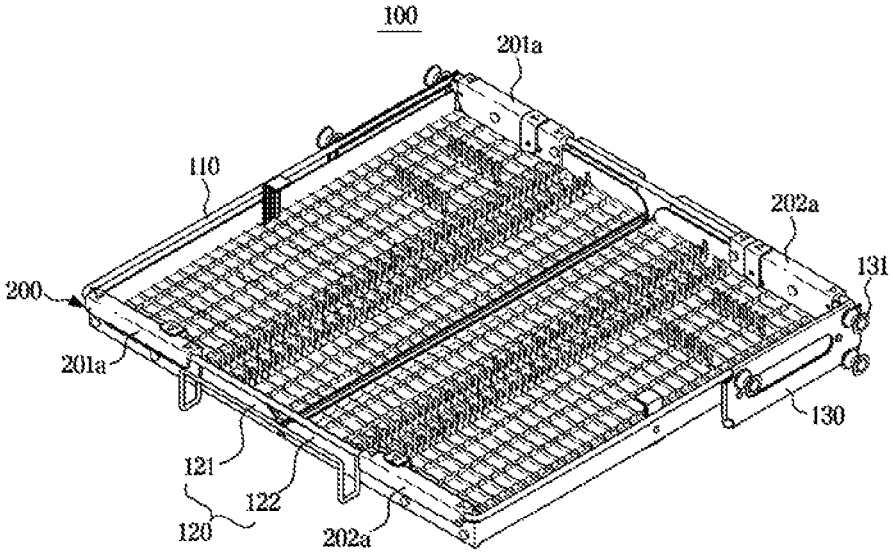
FIG. 3 is a perspective view illustrating a rack assembly of a dishwasher according to an embodiment of the disclosure.

FIG. 1 is a cross-sectional view of a dishwasher according to an embodiment of the disclosure. FIG. 2 is a perspective view of a dishwasher according to an embodiment of the disclosure when a door of the dishwasher opens. FIG. 3 is a perspective view illustrating a rack assembly of a dishwasher according to an embodiment of the disclosure.

As illustrated in FIGS. 1 to 3, a dishwasher 1 may include a washing tub 12 positioned inside a main body 10. The washing tub 12 may be substantially in a shape of a box. One side of the washing tub 12 may open. In the open side of the washing tub 12, a door 11 may be provided to open and close the washing tub 12. The door 11 may be installed on the main body 10. The door 11 may be rotatably installed on the main body 10.

Inside the washing tub 12, a basket 50 or a rack assembly 100 which can be drawn and on which dishes are placed may be provided.

Dishes of relatively large volumes may be accommodated in the basket 50. Kinds and sizes of dishes that are accommodated in the basket 50 are not limited. Dishes of relatively large volumes and dishes of relatively small volumes may be accommodated in the basket 50.

The basket 50 may include a first basket 51 and a second basket 52. The first basket 51 may be positioned above the second basket 52. The first basket 51 may be positioned in an upper space of the washing tub 12. The second basket 52 may be positioned in a lower space of the washing tub 12.

In the washing tub 12, a first guide rack 13*a* on which the first basket 51 is supported may be provided. In the washing tub 12, a second guide rack 13*b* on which the second basket 52 is supported may be provided.

The first guide rack 13*a* and the second guide rack 13*b* may be installed in the washing tub 12 such that the first basket 51 and the second basket 52 are slidable toward a front side of the washing tub 12. The first guide rack 13*a* and the second guide rack 13*b* may be installed on left and right side surfaces of the washing tub 12. The first basket 51 and the second basket 52 may slide in a front-back direction of the washing tub 12 along the first guide rack 13*a* and the second guide rack 13*b*.

The rack assembly 100 may be installed in the washing tub 12 to accommodate dishes. The rack assembly 100 may be installed in the upper space of the washing tub 12. The rack assembly 100 may be installed in an uppermost space of the washing tub 12. Dishes of relatively small volumes may be accommodated in the rack assembly 100. In the rack assembly 100, cutlery, culinary objects, etc. may be accommodated. For example, cutlery, culinary objects, etc. may include a ladle, a knife, a spatula, etc. As objects that are accommodated in the rack assembly 100, dishes, cutlery, etc. having small volumes have been described as examples, however, objects that are accommodated in the rack assembly 100 are not limited to these.

The dishwasher 1 may include a sump 20 for collecting and storing washing water. In the sump 20, a washing pump 21 for pumping stored water to a spraying unit may be installed. Washing water pumped by the washing pump 21 may be supplied to a first spraying unit 41 and a second spraying unit 42 which will be described later, through a first supply pipe 31, or supplied to a third spraying unit 43 which will be described later, through the first supply pipe 31.

The dishwasher 1 may further include a heater 15 positioned below the washing tub 12 to heat washing water, and a drain pump 22 positioned below the washing tub 12 to drain washing water.

The dishwasher 1 may include the first to third spraying units 41, 42, and 43 for spraying washing water. The first to third spraying units 41, 42, and 43 may include the first spraying unit 41 positioned above the first basket 51, the second spraying unit 42 positioned above the second basket 52, that is, between the first basket 51 and the second basket 52, and the third spraying unit 43 positioned below the second basket 52. The first spraying unit 41 may be positioned above the rack assembly 100.

The first spraying unit 41 may be rotatable. The first spraying unit 41 may spray washing water toward dishes accommodated in the rack assembly 100 and the first basket 51.

The second spraying unit 42 may be rotatable. The second spraying unit 42 may spray washing water toward dishes accommodated in the first basket 51 and the second basket 51.

The third spraying unit 43 may be fixed at one side of a lower portion of the washing tub 12, unlike the first spraying unit 41 and the second spraying unit 42. The third spraying unit 43 may spray washing water in a substantially horizontal direction. The third spraying unit 43 may include a plurality of nozzles 44 through which washing water is sprayed. The nozzles 44 may be arranged at preset intervals in a line from one side of the washing tub 12 to the opposite side of the washing tub 12. Washing water spayed in the horizontal direction from the nozzles 44 of the third spraying unit 43 may change its heading direction by a conversion assembly 60 positioned inside the washing tub 12 to travel toward the dishes accommodated in the second basket 52.

The conversion assembly 60 may be installed on a rail 62 by a holder 64, and movable along the rail 62.

The rack assembly 100 may be mounted on a guide rail 70 of the washing tub 12 to be slidable along the guide rail 70.

guide rails 70 may be respectively installed on the left and right side surfaces of the washing tub 12. The guide rails 70 may be respectively installed on left and right inner surfaces of the washing tub 12. The rack assembly 100 may include a mounting member 130 having a plurality of guide rollers 131 to be coupled with the guide rails 70 and slide. The mounting member 130 may be installed on a frame 110 of the rack assembly 100, which will be described later. mounting members 130 may be respectively installed on rear end portions of both side surfaces of the rack assembly 100.

Accordingly, the rack assembly 100 may slide along the guide rail 70 by the mounting member 130 to move in the front-back direction of the washing tub 12.

The rack assembly 100 may include a frame 110, and a tray 120 coupled with the frame 110.

The frame 110 may include a quadrangular frame made of a steel bar.

The tray 120 may be coupled with a lower portion of the frame 110. trays 120 may be provided respectively in both left and right sides of the frame 110. The trays 120 may be bilaterally symmetrical. The trays 120 may include a first tray 121 positioned to one side of the frame 110, and a second tray 122 positioned to the other side of the frame 110. The first tray 121 and the second tray 122 may be positioned to the left and right sides of the frame 110, and have the same shape. Because the first tray (hereinafter, also referred to as a 'tray') 121 and the second tray 122 include the same components, overlapping descriptions about the same components will be omitted.

Each of the first tray 121 and the second tray 122 may be rotatably connected to the frame 110 through a link unit 200. The link unit 200 may connect the tray 120 to the frame 110. The link unit 200 may connect the tray 120 to the frame 110, and be rotatably connected to the frame 110 and the tray 120.

The link unit 200 may include a pair of first link portions 120*a* respectively facing front and rear portions of the first tray 121, and a pair of second link portions 120*b* respectively facing front and rear portions of the second tray 122.

The first tray 121 may be rotatably connected to the frame 110 by the first link portions 120*a*, and the second tray 122 may be rotatably connected to the frame 110 by the second link portions 120*b*.

Figure 4:
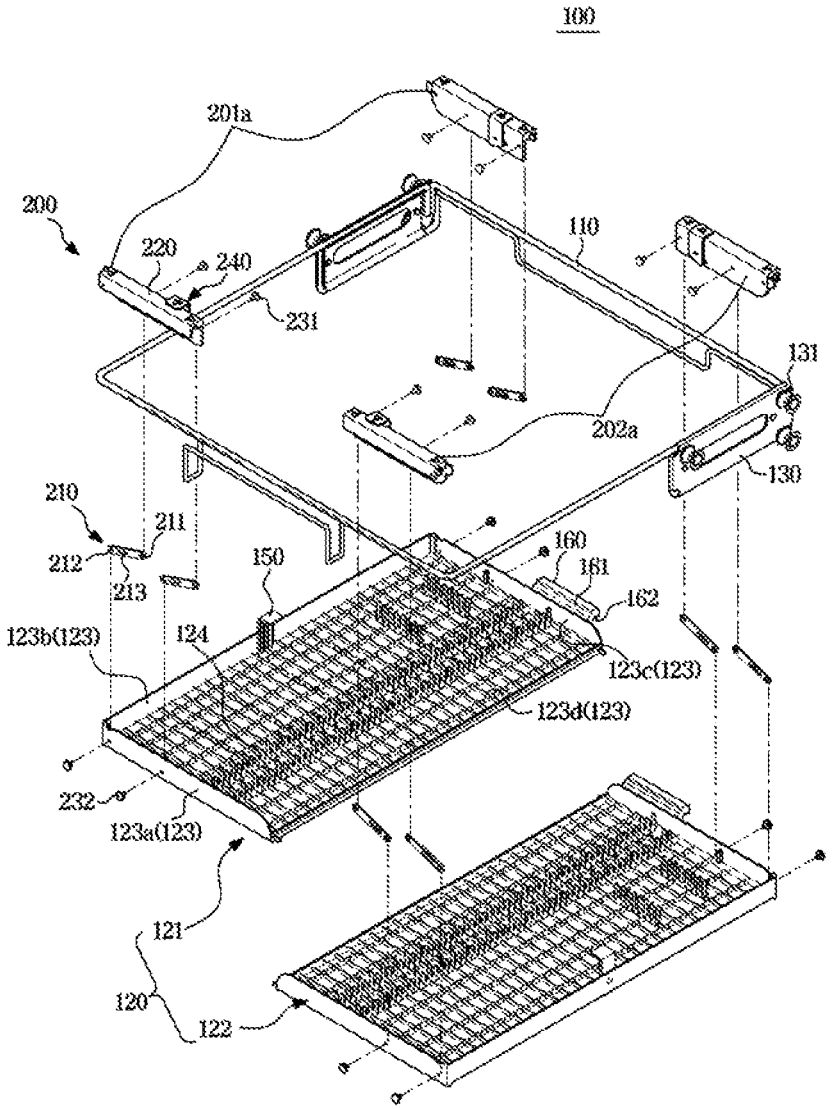
FIG. 4 is an exploded perspective view of a rack assembly in which a link unit according to an embodiment of the disclosure is installed.
Figure 5:
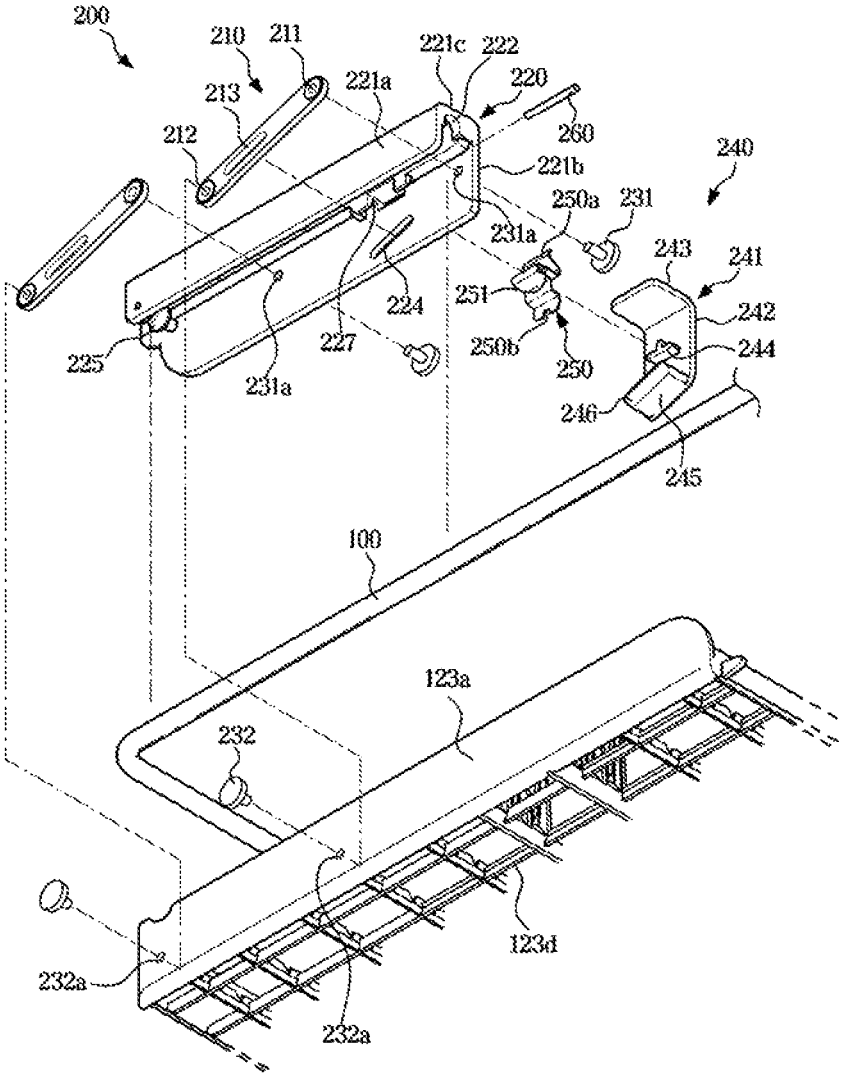
FIG. 5 is an exploded perspective view illustrating a link unit according to an embodiment of the disclosure.
Figure 6:
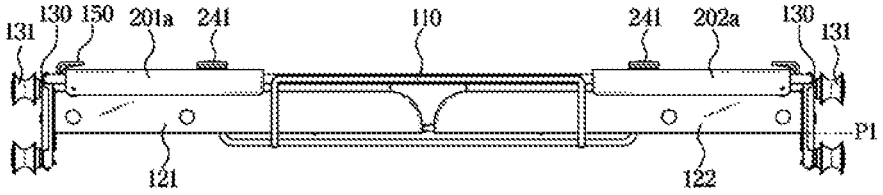
FIG. 6 is a front view of a rack assembly according to an embodiment of the disclosure.
Figure 7:
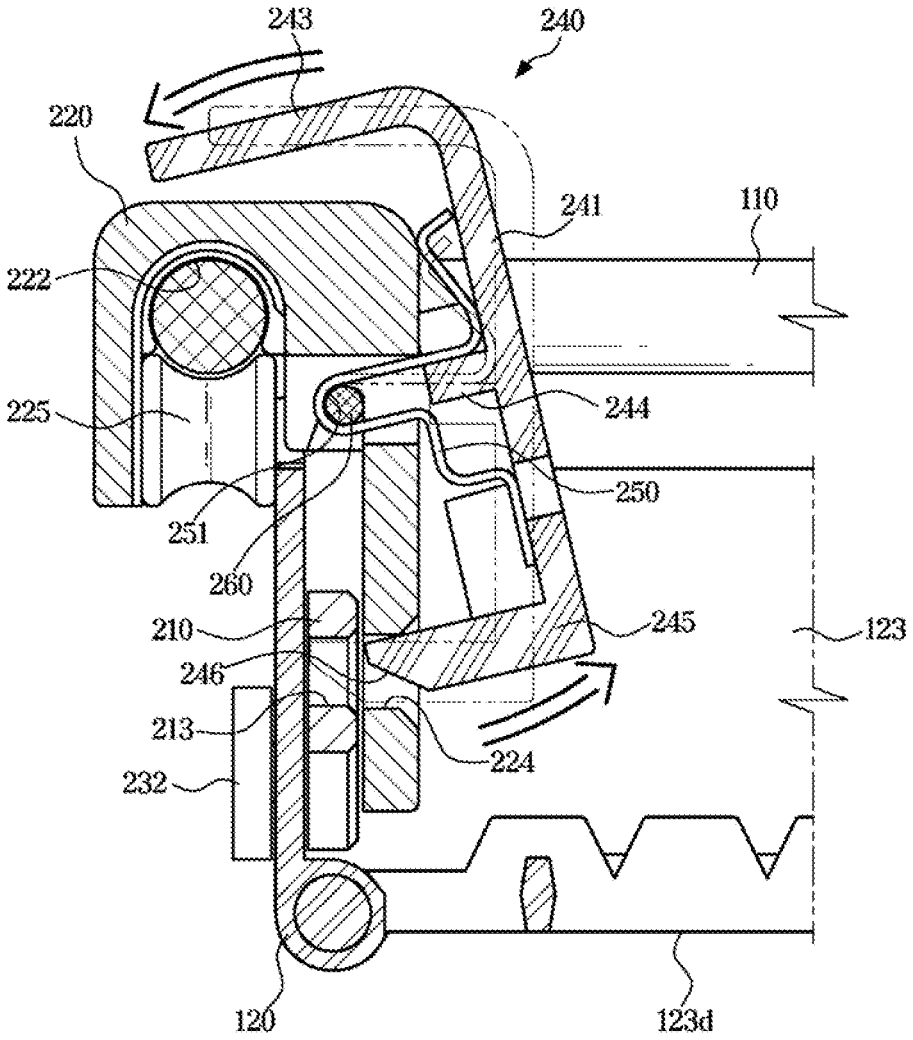
FIG. 7 is a cross-sectional view illustrating an operation of a lever device of a link unit according to an embodiment of the disclosure.

FIG. 4 is an exploded perspective view of a rack assembly in which a link unit according to an embodiment of the disclosure is installed. FIG. 5 is an exploded perspective view illustrating a link unit according to an embodiment of the disclosure. FIG. 6 is a front view of a rack assembly according to an embodiment of the disclosure. FIG. 7 is a cross-sectional view illustrating an operation of a lever device of a link unit according to an embodiment of the disclosure.

As illustrated in FIGS. 4 to 7, the rack assembly 100 may include the frame 110, and the tray 120 connected to the frame 110.

The tray 120 may include a tray frame 123 forming outer edges, and a tray bottom 123*d* extending from the tray frame 123.

The tray frame 123 may form side walls of the tray 120. The tray frame 123 may form a front plate 123*a*, a side plate 123*b*, and a rear plate 123*c*. The tray bottom 123*d* may be made of a plurality of bars or a plurality of wires. The tray bottom 123*d* may include a plurality of holes formed by the plurality of bars or the plurality of wires.

The tray bottom 123*d* may include a plurality of dish holders 124 for supporting cutlery or culinary objects. The dish holders 124 may protrude upward from the tray bottom 123*d*. The dish holders 124 may have a preset length from the tray bottom 123*d*. The dish holders 124 may protrude to different heights from the tray bottom 123*d*.

The tray 120 may be rotatably connected to the frame 110 by the link unit 200. link units 200 may be respectively installed at the front and rear portions of the tray 120.

The link unit 200 may include a moving bracket 220 movably supported on the frame 110, a link member 210 rotatably connecting the moving bracket 220 to the tray 120, and a lever device 240 restricting movements of the link member 210 to fix the tray 120.

The moving bracket 220 may surround an outer surface of the frame 110. The moving bracket 220 may include a first plate 221*a*, a second plate 221*b* being opposite to the first plate 221*a*, and a third plate 221*c* connecting the first plate 221*a* to a second plate 221*b*. The third plate 221*c* may connect an upper end of the first plate 221*a* to an upper end of the second plate 221*b*. The third plate 221*c* may support an upper portion of the frame 110. At an inner side of the third plate 221*c*, a frame supporting groove 222 on which the frame 110 is rested may be formed. At the inner side of the third plate 221*c*, the frame supporting groove 222 having a shape corresponding to the frame 110 may be formed. According to an embodiment of the disclosure, an example in which the first plate 221*a* is positioned in front of the frame 110, and the second plate 221*b* is positioned behind the frame 110, wherein a length of the second plate 221*b* is longer than that of the first plate 221*a* and the lever device 240 is installed on the second plate 221*b* is shown, although the concept of the disclosure is not limited thereto. A shape of the frame 110 and an installation location of the lever device 240 may change.

The moving bracket 220 may move along the frame 110. The frame supporting groove 222 of the moving bracket 220 may be movably coupled with the frame 110. The frame supporting groove 222 may support the upper portion of the frame 110.

The moving bracket 220 may further include a roller 225 that is supported and moves on the frame 110. The roller 225 may be positioned between the first plate 221*a* and the second plate 221*b*. The roller 225 may support a lower portion of the frame 110. The roller 225 may be positioned at one side of the moving bracket 220.

On the moving bracket 220, the link member 210 may be provided to rotatably connect the moving bracket 220 to the tray 120. On the second plate 221*b* of the moving bracket 220, the link member 210 may be rotatably installed to rotatably connect the moving bracket 220 to the tray 120.

On the second plate 221*b* of the moving bracket 220, the link member 210 may be rotatably installed. In the second plate 221*b*, a first connecting hole 231*a* to which at least one end of the link member 210 is rotatably connected may be formed.

The link member 210 may be in a shape of a bar. The link member 210 may include a first connecting portion 211 rotatably connected to the moving bracket 220, and a second connecting portion 212 rotatably connected to the tray 120. The first connecting portion 211 and the second connecting portion 212 may be respectively formed at both end portions of the link member 210.

The first connecting portion 211 of the link member 210 may be rotatably connected to the first connecting hole 231*a* of the moving bracket 220. The first connecting portion 211 of the link member 210 may be rotatably connected to the first connecting hole 231*a* of the moving bracket 220 through a first connecting member 231. A first connecting member 231 may pass through the first connecting hole 231*a* of the moving bracket 220 to be pressed in the first connecting portion 211 and fixed.

The second connecting portion 212 of the link member 210 may be rotatably connected to the tray 120. The second connecting portion 212 of the link member 210 may be rotatably connected to the tray frame 123 of the tray 120. In the tray frame 123, a second connecting hole 232*a* corresponding to the second connecting portion 212 may be formed. In each of the front plate 123*a* and rear plate 123*c* of the tray frame 123, the second connecting hole 232*a* corresponding to the second connecting portion 212 may be formed. The second connecting portion 212 of the link member 210 may be rotatably connected to the second connecting hole 232*a* of the tray 120 through a second connecting member 232. The second connecting member 232 may pass through the second connecting portion 212 of the link member 210 to be pressed in the second connecting hole 232*a* of the tray 120 and fixed.

The first connecting portion 211 of the link member 210 may be rotatably connected to the moving bracket 220, and the second connecting portion 212 may be rotatably connected to the tray 120.

That is, the tray 120 may move by a rotation of the link member 210 on the first connecting portion 211 of the link member 210.

The link member 210 may include a slot 213 formed between the first connecting portion 211 and the second connecting portion 212. The slot 213 of the link member 210 may be coupled with or decoupled from the lever device 240 which will be described later to restrict movements of the link member 210.

The slot 213 of the link member 210 may be formed with a preset length in a longitudinal direction of the link member 210.

The moving bracket 220 may include the lever device 240 for restricting movements of the link member 210. The lever device 240 may be installed on the moving bracket 220. The lever device 240 may be installed on the second plate 221*b* of the moving bracket 220.

The lever device 240 may include a lever 241 rotatably installed on the moving bracket 220, a rotating shaft 260 rotatably connecting the lever 241 to the moving bracket 220, and an elastic member 250 positioned between the lever 241 and the moving bracket 220 to elastically support the lever 241 and the moving bracket 220.

The lever 241 may include a lever pressing portion 243, a fixing portion 245 interworking with the lever pressing portion 243 to be coupled with or decoupled from the slot 213 of the link member 210, and a lever body 242 connecting the lever pressing portion 243 to the fixing portion 245. The lever pressing portion 243, the fixing portion 245, and the lever body 242 of the lever 241 may be integrated into one body.

On an inner surface of the lever body 242, an elastic member installing portion 244 on which the elastic member 250 is installed may be formed. The elastic member 250 may include a plate spring.

The elastic member 250 may include a first elastic supporting portion 250*a* and a second elastic supporting portion 250*b*, and a rotating shaft accommodating portion 251 positioned between the first elastic supporting portion 250*a* and the second elastic supporting portion 250*b*. The rotating shaft accommodating portion 251 may protrude in a rear direction of the first elastic supporting portion 250*a* and the second elastic supporting portion 250*b*. The rotating shaft accommodating portion 251 may be formed at a location corresponding to the elastic member installing portion 244 of the lever body 242. The elastic member 250 may elastically support upper and lower portions of the lever body 242 with the rotating shaft accommodating portion 251 in the center.

In the embodiment of the disclosure, an example in which the elastic member 250 is provided separately from the lever 241 and coupled with the lever 241 is shown. However, the concept of the disclosure is not limited to this. For example, the elastic member 250 and the lever 241 may be integrated into one body.

The rotating shaft 260 may be rotatably accommodated in the rotating shaft accommodating portion 251 of the elastic member 250. The rotating shaft 260 may be installed in the moving bracket 220. The moving bracket 220 may include a rotating shaft installing portion 227 in which the rotating shaft 260 is installed. The rotating shaft installing portion 227 may be provided on the second plate 221*b* of the moving bracket 220. The rotating shaft accommodating portion 251 of the elastic member 250 may be installed in the rotating shaft installing portion 227 of the moving bracket 220 together with the rotating shaft 260.

The elastic member 250 may rotatably and elastically support the lever 241 with the rotating shaft 260 in the center.

The fixing portion 245 of the lever 241 may be provided at a lower end of the lever body 242. The fixing portion 245 may be formed in a bent shape at the lower end of the lever body 242. The fixing portion 245 may protrude toward the moving bracket 220.

In the moving bracket 220, a lever through hole 224 through which the fixing portion 245 of the lever 241 passes to be coupled with or decoupled from the slot 213 of the link member 210 may be formed. The lever through hole 224 may be formed in the second plate 221*b* of the moving bracket 220. The lever through hole 224 may be formed at a location corresponding to the slot 213 of the link member 210. The lever through hole 224 may be formed with a shape corresponding to the slot 213 of the link member 210.

When the lever 241 does not rotate, the fixing portion 245 may be in a state of being inserted in the lever through hole 224 of the moving bracket 220 and the slot 213 of the link member 210. When the lever pressing portion 243 is pressed, the lever body 242 and the fixing portion 245 may rotate in a rear direction on the rotating shaft 260 and be separated from the slot 213 of the link member 210 and the lever through hole 224.

When the fixing portion 245 of the lever 241 is separated from the slot 213 of the link member 210, the link member 210 may be separated from the moving frame 110.

The fixing portion 245 may include a guide portion 246 inclined to guide the fixing portion 245 to be easily coupled with the slot 213 of the link member 210 and the lever through hole 224 of the moving bracket 220. The guide portion 246 may facilitate coupling and decoupling when the lever 241 returns.

The link member 210 may rotate on the first connecting portion 211 fixed on the moving bracket 220. At this time, the tray 120 connected to the second connecting portion 212 of the link member 210 may move downward by a length of the link member 210.

Figure 8:
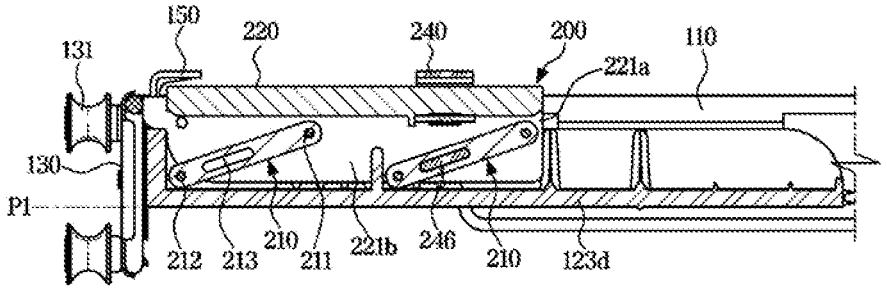
FIG. 8 illustrates a tray positioned at a first location by a link unit according to an embodiment of the disclosure.
Figure 9:
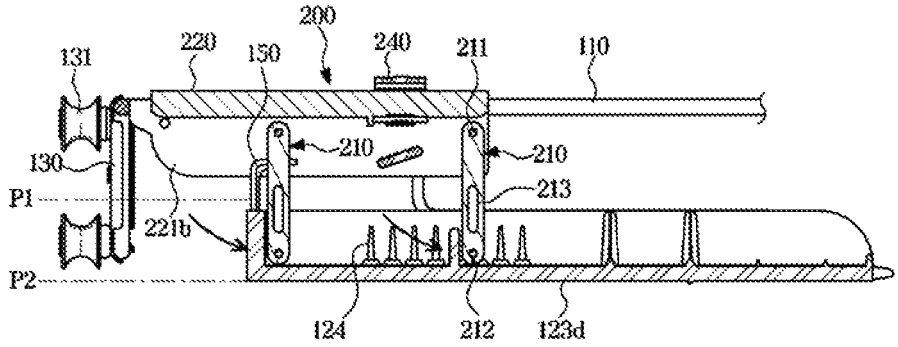
FIG. 9 illustrates a tray positioned at a second location by a link unit according to an embodiment of the disclosure.
Figure 10:
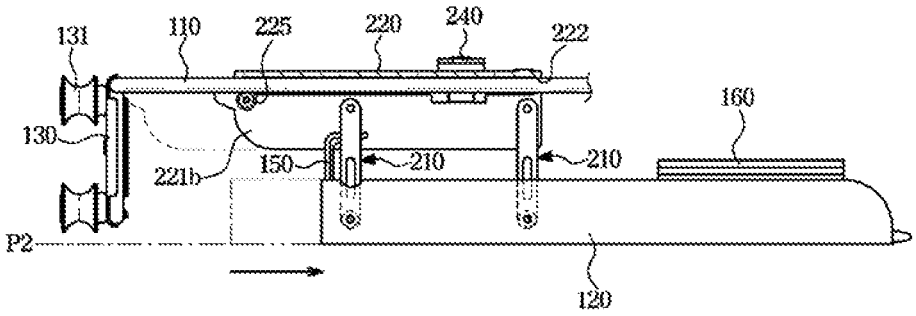
FIGS. 10 to 13 illustrate a movement of a tray according to an embodiment of the disclosure.
Figure 11:
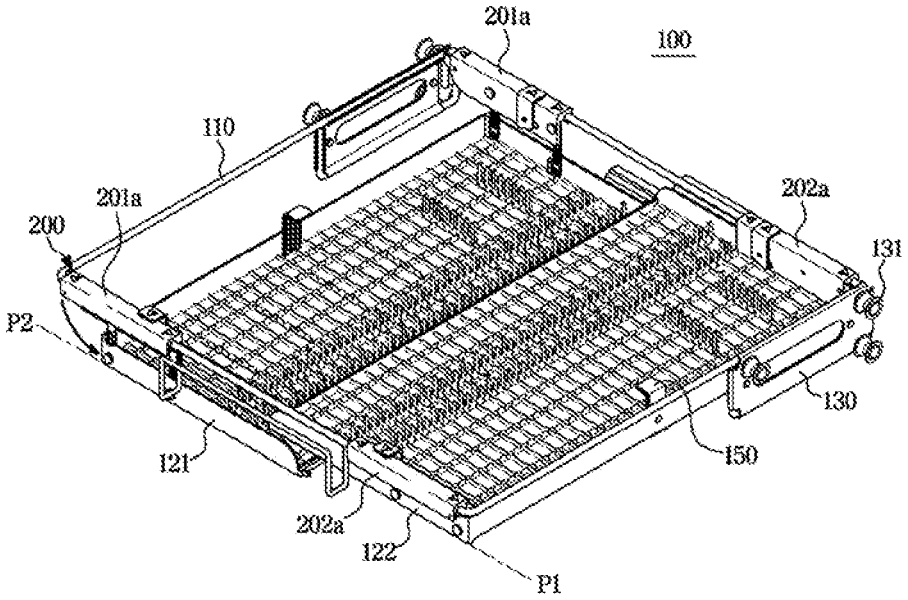
Figure 12:
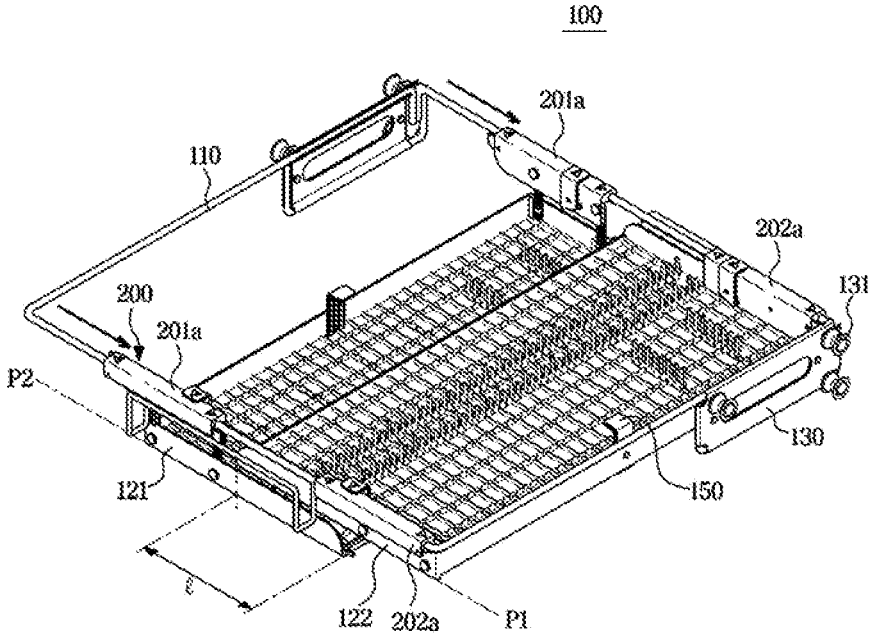
Figure 13:
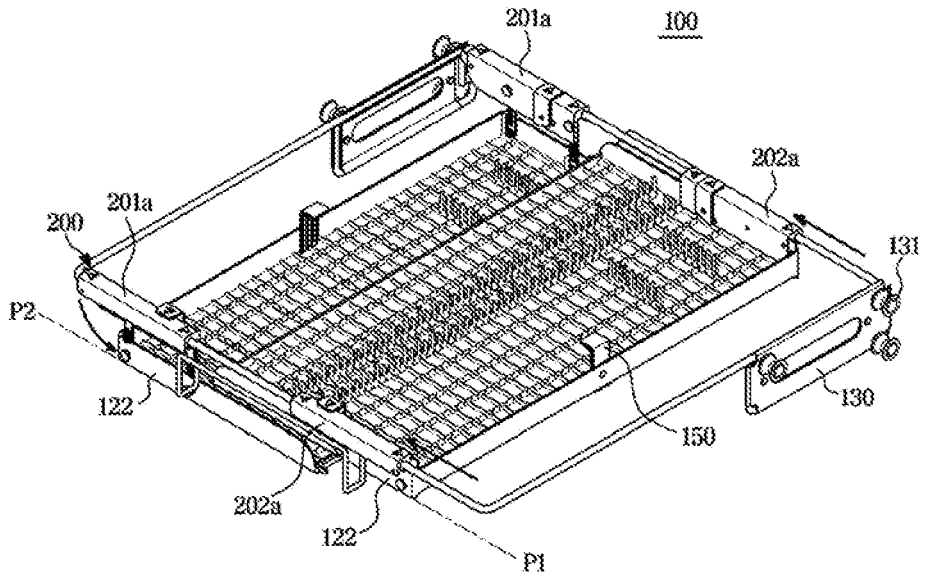

FIG. 8 illustrates a tray positioned at a first location by a link unit according to an embodiment of the disclosure, and FIG. 9 illustrates a tray positioned at a second location by a link unit according to an embodiment of the disclosure.

As illustrated in FIGS. 8 and 9, when the tray 120 is at a first location P1, the link unit 200 may cause the lever 241 to restrict movements of the link member 210.

The lever 241 may be elastically supported on the moving bracket 220 by the elastic member 250. The fixing portion 245 of the lever 241 may pass through the lever through hole 224 of the moving bracket 220 and be inserted in the slot 213 of the link member 210.

The fixing portion 245 inserted in the slot 213 of the link member 210 may restrict a rotation of the link member 210 to cause the tray 120 to be positioned at the first location P1 that is relatively close to the frame 110.

When the tray 120 is at a second location P2, the lever 241 of the link unit 200 may be separated from the slot 213 of the link member 210 so that the link member 21 can move. The fixing portion 245 of the lever 241 may be maintained in a state of being inserted in the lever through hole 224 of the moving frame 110.

To move the tray 120 from the first location P1 to the second location P2, the lever pressing portion 243 of the lever 241 may be pressed. When the lever pressing portion 243 is pressed, the fixing portion 245 may move in the rear direction with respect to the rotating shaft 260, and be decoupled from the lever through hole 224 and the slot 213 of the link member 210. After the fixing portion 245 is decoupled from the slot 213 of the link member 210, the link member 210 may rotate and move on the first connecting portion 211. The tray 120 connected to the second connecting portion 212 of the link member 210 may move downward by its own weight.

On the contrary, to move the tray 120 from the second location P2 to the first location P1, a handle 150 provided in the tray 120 may be drawn to move the tray 120 upward.

When the tray 120 moves to the first location P1, pressure applied to the lever 241 may be removed, and the fixing portion 245 of the lever 241 may be coupled with the slot 213 of the link member 210 through the lever through hole 224 of the moving bracket 220.

At this time, the fixing portion 245 may easily return to its original location by the elastic member 250 that elastically supports the lever 241 and the moving bracket 220.

FIGS. 10 to 13 illustrate a movement of a tray according to an embodiment of the disclosure.

As illustrated in FIGS. 10 to 13, the tray 120 may move in a left-right direction of the frame 110. The tray 120 may be connected to the moving bracket 220. The moving bracket 220 may be movable on the frame 110.

The first tray 121 positioned at the second location P2 may move toward the second tray 122 positioned at the first location P1. The first tray 121 positioned at the second location P2 may be positioned below the second tray 122 positioned at the first location P1 such that at least one portion 1 of the first tray 121 overlaps the second tray 122.

In this way, when the first tray 121 moves toward the second tray 122, a washing space of the first tray 121 may be expanded. By the expanded washing space, dishes having more various sizes may be accommodated, and washing performance may be improved.

Also, the second tray 122 positioned at the first location P1 may move toward the first tray 121 positioned at the second location P2. The second tray 122 positioned at the first location P1 may be positioned above the first tray 121 positioned at the second location P2 such that at least one portion of the second tray 122 overlaps the first tray 121.

In this way, when the second tray 122 moves toward the first tray 121, a washing space of the second tray 122 may be expanded. By the expanded washing space, dishes having more various sizes and shapes may be accommodated, and washing performance may be improved accordingly.

While the present disclosure has been particularly described with reference to exemplary embodiments, it should be understood by those of skilled in the art that various changes in form and details may be made without departing from the spirit and scope of the present disclosure.

The invention claimed is:

1. A dishwasher comprising:

a washing tub; and a rack assembly provided inside the washing tub, wherein the rack assembly comprises:

a frame;

a tray on which dishes are accommodated and which is movably supported on the frame; and a link unit connecting the frame to the tray and moving the tray to one of a first location and a second location that is lower than the first location, the link unit being rotatably coupled with the frame and the tray, wherein the link unit comprises a moving bracket movable along the frame, and a link member connecting the moving bracket to the tray and rotatably coupled with the moving bracket and the tray, and wherein the moving bracket comprises a frame supporting groove having a shape corresponding to the upper portion of the frame, and a roller supporting a lower portion of the frame.

2. The dishwasher of claim 1, wherein the link member comprises a first connecting portion rotatably connected to the moving bracket, and a second connecting portion rotatably connected to the tray, wherein the first connecting portion and the second connecting portion are positioned at both end portions of the link member.

3. The dishwasher of claim 2, wherein the link unit comprises a lever device restricting a movement of the link member such that the tray is positioned at the first location.

4. The dishwasher of claim 3, wherein the lever device comprises a lever rotatably installed in the moving bracket, and a slot formed in the link member and being coupled with or decoupled from the lever.

5. The dishwasher of claim 4, wherein the lever comprises a fixing portion that
is coupled with or decoupled from the slot.

6. The dishwasher of claim 5, wherein the fixing portion comprises a guide portion inclined to guide the fixing portion to be coupled with or decoupled from the slot.

7. The dishwasher of claim 4, wherein the lever is rotatably installed in the moving bracket.

8. The dishwasher of claim 4, wherein the lever comprises an elastic member
positioned between the lever and the moving bracket to elastically support the lever and the moving bracket.

9. The dishwasher of claim 4, wherein the tray interworks with a rotation of the lever, and rotates by weight of the tray when the tray moves from the first location to the second location.

10. The dishwasher of claim 1, wherein the link member is provided as a plurality of pieces.

11. The dishwasher of claim 1, wherein the tray comprises a first tray and a second tray, and the first tray and the second tray are provided in both left and right sides of the frame to be symmetrical to each other.

12. The dishwasher of claim 11, wherein the first tray positioned at the second
location is movable toward the second tray positioned at the first location, and the first tray and the second tray are stacked at upper and lower locations.

13. The dishwasher of claim 1, wherein the tray comprises at least one handle.

* * * * *